US007998647B2

(12) United States Patent
Maeyama

(10) Patent No.: US 7,998,647 B2
(45) Date of Patent: Aug. 16, 2011

(54) ELECTROSTATIC IMAGE DEVELOPING TONER, ELECTROSTATIC IMAGE DEVELOPER, IMAGE FORMING METHOD, IMAGE FORMING APPARATUS AND PRINTED MATTER

(75) Inventor: Ryuichiro Maeyama, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1316 days.

(21) Appl. No.: 11/594,162

(22) Filed: Nov. 8, 2006

(65) Prior Publication Data

US 2007/0243478 A1 Oct. 18, 2007

(30) Foreign Application Priority Data

Apr. 18, 2006 (JP) ..... 2006-114493

(51) Int. Cl.
*G03G 9/00* (2006.01)

(52) U.S. Cl. ..... 430/108.2; 430/123.5

(58) Field of Classification Search ..... 430/108.2, 430/123.5
See application file for complete search history.

(56) References Cited

U.S. PATENT DOCUMENTS

| | | | | |
|---|---|---|---|---|
| 5,472,819 | A * | 12/1995 | Hayashi et al. | 430/108.2 |
| 7,267,920 | B2 | 9/2007 | Nakazawa et al. | |
| 2005/0175923 | A1 | 8/2005 | Nakazawa et al. | |

FOREIGN PATENT DOCUMENTS

| | | |
|---|---|---|
| CN | 1652033 A | 8/2005 |
| JP | A 2003-147396 | 5/2003 |
| JP | A 2004-217788 | 8/2004 |

* cited by examiner

*Primary Examiner* — Thorl Chea
(74) *Attorney, Agent, or Firm* — Oliff & Berridge, PLC

(57) ABSTRACT

An electrostatic image developing toner comprising an amide ester represented by formula (1):

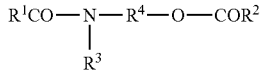

(1)

wherein $R^1CO$— and $R^2CO$— each independently represents a saturated or unsaturated acyl group having a carbon number of 16 to 24, which may have a hydroxyl group; $R^3$ represents a linear or branched alkyl group having a carbon number of 1 to 3; and $R^4$ represents a linear or branched alkylene group having a carbon number of 1 to 6 or a linear or branched alkenylene group having a carbon number of 2 to 6.

18 Claims, No Drawings

ELECTROSTATIC IMAGE DEVELOPING TONER, ELECTROSTATIC IMAGE DEVELOPER, IMAGE FORMING METHOD, IMAGE FORMING APPARATUS AND PRINTED MATTER

BACKGROUND

1. Technical Field

The present invention relates to an electrostatic image developing toner usable in an electrophotographic apparatus (image forming apparatus) utilizing an electro-photographic process, such as duplicator, printer and facsimile. The present invention also relates to an electrostatic image developer using the electrostatic image developing toner, an image forming method, an image forming apparatus and a printed matter.

2. Related Art

At present, a method of visualizing image information through an electrostatic latent image, such as electrophotographic process, is being widely utilized in various fields. In the electrophotographic process, an electrostatic image (electrostatic latent image) formed on an electrophotographic photoreceptor (electrostatic latent image carrying member; hereinafter sometimes referred to as a "photoreceptor") through an electrostatic charging step, an exposure step and the like is developed with an electrostatic image developing toner (hereinafter sometimes simply referred to as a "toner"), and the electrostatic image is then visualized through a transfer step, a fixing step and the like.

In recent years, an image forming method by electrophotography using the above-described toner or developer technology has begun to be applied to a part of the printing region along with progress of digitalization and color processing, and its practical use is remarkably proceeding in the graphic art market including on-demand printing. The graphic art market as used herein indicates a business market in general relating to the production of a printed matter implemented by the copying or duplication of a creative printed matter produced in a small number by means of engraving or the like, or an original such as calligraphy and picture, or by the mass production system called reproduction, and is defined as a market targeting trades and services involving the production of a printed matter.

However, when compared with the original genuine conventional printing, despite the on-demand feature by virtue of plateless printing, it has been found that in order to fully substitute the printing and pursue the market value particularly as a production good in the graphic art region, there are still many problems to be solved in view of performance, such as color reproduction region, resolution, image quality represented by gloss characteristics, texture, image quality uniformity in the same image, and maintenance of image quality at continuous printing for a long period.

SUMMARY

According to an aspect of the invention, there is provided an electrostatic image developing toner comprising an amide ester represented by formula (1):

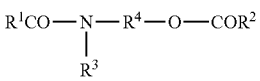

(1)

wherein $R^1CO$— and $R^2CO$— each independently represents a saturated or unsaturated acyl group having a carbon number of 16 to 24, which may have a hydroxyl group;

$R^3$ represents a linear or branched alkyl group having a carbon number of 1 to 3; and $R^4$ represents a linear or branched alkylene group having a carbon number of 1 to 6 or a linear or branched alkenylene group having a carbon number of 2 to 6.

DETAILED DESCRIPTION

The present invention is described in detail below.

(Electrostatic Image Developing Toner)

The electrostatic image developing toner (hereinafter sometimes simply referred to as a "toner") of the present invention is characterized by comprising an amide ester represented by the following formula (1). The electrostatic image developing toner of the present invention preferably comprises a binder resin and a colorant and, if desired, may further contain other components such as releasing agent.

<Amide Ester Represented by Formula (1)>

The electrostatic image developing toner of the present invention comprises an amide ester represented by the following formula (1). One of the amide esters represented by formula (1) may be used alone, or two or more species thereof may be used in combination.

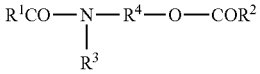

(1)

(wherein $R^1CO$— and $R^2CO$— each independently represents a saturated or unsaturated acyl group having a carbon number of 16 to 24, which may have a hydroxyl group, $R^3$ represents a linear or branched alkyl group having a carbon number of 1 to 3, and $R^4$ represents a linear or branched alkylene group having a carbon number of 1 to 6 or a linear or branched alkenylene group having a carbon number of 2 to 6).

In formula (1), $R^1CO$— and $R^2CO$— each independently represents a saturated or unsaturated acyl group having a carbon number of 16 to 24, which may have a hydroxyl group. When $R^1CO$— and $R^2CO$— each is a group within this range, good pearl luster can be imparted.

In particular, the acyl group is preferably an acyl group obtained by removing OH in the COOH group from a palmitic acid, a stearic acid or an isostearic acid, more preferably an acyl group obtained by removing OH in the COOH group from a palmitic acid or a stearic acid.

In formula (1), from the standpoint that an active NH group of the amide bond can be eliminated and the effect of pH or the formation of a salt can be suppressed, $R^3$ is a linear or branched alkyl group having a carbon number of 1 to 3, preferably a methyl group or an ethyl group, more preferably a methyl group.

In formula (1), $R^4$ is a linear or branched alkylene group having a carbon number of 1 to 6 or a linear or branched alkenylene group having a carbon number of 2 to 6, preferably a linear or branched alkylene group having a carbon number of 2 or 3.

Specific preferred examples of the amide ester represented by formula (1), which can be used in the present invention, include an N-stearoyl-N-methylaminoalkyl stearate. Among these, N-stearoyl-N-methylaminoethyl stearate is more preferred.

The toner of the present invention comprises an amide ester represented by formula (1) and thereby produces an effect of imparting gloss to an image formed by using the toner, and the mechanism thereof is considered as follows.

The above-described amide ester is partially compatibilized with a binder resin of the toner, and the toner of the present invention comprising the amide ester elongates under pressure by a fixing member when heated at the fixing and exhibits good releasability when the fixing member is removed, so that an effect of maintaining smoothness can be obtained. Also, by virtue of containing the amide ester, an effect of reducing change in the volume when cooling the resin is provided and therefore, high glossiness can be maintained.

Furthermore, by virtue of containing the amide ester, the toner of the present invention is less dependent on the fixing pressure, so that even when an image having a difference in the toner coverage within one image sheet, such as full color image, is used, an image reduced in the difference of glossiness due to toner coverage can be obtained.

Since the amide ester represented by formula (1) has high melting point and high polarity and is assured of sufficient compatibility with a toner binder resin, this amide ester is preferably used for a polycondensation-type toner having high polarity rather than for a polymerization-type toner generally having low polarity. As for the polycondensation-type toner, use of a resin obtained by low-temperature polycondensation is more preferred.

Also, the toner can advantageously give good fragrance due to the amide ester represented by formula (1) contained therein.

The amount used of the amide ester represented by formula (1) is preferably from about 5 to about 65 wt %, more preferably from about 10 to about 60 wt %, still more preferably from about 10 to about 40 wt %, based on the total weight of the toner. When the amount of the amide ester used is in this range, the flowability of the toner formed is on the same level as that when the amide ester is not added, and this is preferred.

<Binder Resin>

Examples of the binder resin which can be used for the electrostatic image developing toner of the present invention include an ethylene-based resin such as polyethylene and polypropylene, a styrene-based resin mainly comprising polystyrene, poly(α-methylstyrene) or the like, a (meth) acryl-based resin mainly comprising polymethyl methacrylate, polyacrylonitrile or the like, a (meth)acryl-based resin, a polyamide resin, a polycarbonate resin, a polyether resin, a polyester resin, and a copolymerization resin thereof. In view of electric charge stability or development durability when used as an electrostatic image developing toner, the binder resin is preferably a resin obtained by polymerizing or copolymerizing one species or a plurality of species of ethylenically unsaturated monomer(s), more preferably a styrene-based resin, a (meth)acryl-based resin, a styrene-(meth)acryl-based copolymerization resin or a polyester resin, still more preferably a polyester resin obtained by low-temperature polycondensation.

Examples of the polycondensable monomer used for the production of the above-described polycondensation resin include an aliphatic, alicyclic or aromatic polyvalent carboxylic acid and an alkyl ester thereof, a polyhydric alcohol and an ester compound thereof, a hydroxycarboxylic acid compound, and a polyamine. Examples thereof include a divalent carboxylic acid, a trivalent or greater polyvalent carboxylic acid, a dihydric alcohol, and a trihydric or greater polyhydric alcohol, which are polycondensable monomer components conventionally known and described in Kobunshi Data Handbook: Koso Hen (Polymer Data Handbook: Basic Edition), compiled by The Society of Polymer Science, Japan, Baifu-Kan.

The polycondensable monomer is polycondensed by a direct esterification reaction, a transesterification reaction, a direct amidation reaction or the like, whereby a polycondensation resin is obtained.

The polyvalent carboxylic acid is a compound containing two or more carboxyl groups within one molecule. Out of these compounds, the dicarboxylic acid is a compound containing two carboxyl groups within one molecule, and examples thereof include an oxalic acid, a succinic acid, a fumaric acid, a maleic acid, an adipic acid, a β-methyladipic acid, a malic acid, a malonic acid, a pimelic acid, a tartaric acid, an azelaic acid, a pimelic acid, a sebacic acid, a nonanedicarboxylic acid, a decane-dicarboxylic acid, an undecanedicarboxylic acid, a dodecanedicarboxylic acid, a citraconic acid, a cyclohexane-3,5-diene-1,2-carboxylic acid, a citric acid, a hexahydroterephthalic acid, a mucic acid, a phthalic acid, an isophthalic acid, a terephthalic acid, a tetrachlorophthalic acid, a chlorophthalic acid, a nitrophthalic acid, a p-carboxyphenylacetic acid, a p-phenylenediacetic acid, an m-phenylenediacetic acid, a p-phenylenedipropionic acid, an m-phenylenedipropionic acid, an m-phenylenediglycolic acid, a p-phenylenediglycolic acid, an o-phenylenediglycolic acid, a diphenyl-p,p'-dicarboxylic acid, a 1,1-cyclopentenedicarboxylic acid, a 1,4-cyclohexanedicarboxylic acid, a 1,3-cyclohexanedicarboxylic acid, a 1,2-cyclohexanedicarboxylic acid, a 1,2-cyclohexenedicarboxylic acid, a norbornene-2,3-dicarboxylic acid, a 1,3-adamantanedicarboxylic acid, 1,3-adamantanediacetic acid, a naphthalene-1,4-dicarboxylic acid, a naphthalene-1,5-dicarboxylic acid, a naphthalene-2,6-dicarboxylic acid and an anthracenedicarboxylic acid.

Examples of the polyvalent carboxylic acid other than the dicarboxylic acid include a trimellitic acid, a pyromellitic acid, a naphthalenetricarboxylic acid, a naphthalenetetracarboxylic acid, a pyrenetricarboxylic acid and a pyrenetetracarboxylic acid.

The carboxylic acid above may have a functional group other than a carboxyl group, and a carboxylic acid derivative such as acid anhydride and acid ester may also be used.

Among these polyvalent carboxylic acids, preferred monomers are a sebacic acid, a nonanedicarboxylic acid, a decanedicarboxylic acid, an undecanedicarboxylic acid, a dodecanedicarboxylic acid, a p-phenylenediacetic acid, an m-phenylenediacetic acid, p-phenylenedipropionic acid, an m-phenylenedipropionic acid, a 1,4-cyclohexanedicarboxylic acid, a 1,3-cyclohexanedicarboxylic acid, a naphthalene-1,4-dicarboxylic acid, a naphthalene-1,5-dicarboxylic acid, a naphthalene-2,6-dicarboxylic acid, a trimellitic acid, and a pyromellitic acid.

The polyhydric alcohol is a compound containing two or more hydroxyl groups within one molecule. The polyhydric alcohol is not particularly limited, but examples thereof include the following monomers.

The diol is a compound having two hydroxyl groups within one molecule, and examples thereof include propanediol, butanediol, pentanediol, hexanediol, heptanediol, octanediol, nonanediol, decanediol, dodecanediol, tetradecanediol, hexadecanediol and octadecanediol.

Examples of the polyol other than the diol include glycol, pentaerythritol, hexamethylolmelamine, hexaethylolmelamine, tetramethylolbenzoguanamine and tetraethylolbenzoguanamine.

Examples of the polyhydric alcohol having a cyclic structure include, but are not limited to, monomers such as cyclohexanediol, cyclohexanedimethanol, bisphenol A, bisphenol C, bisphenol E, bisphenol F, bisphenol P, bisphenol S, bisphenol Z, hydrogenated bisphenol, bisphenol, naphthalenediol, 1,3-adamantanediol, 1,3-adamantanedimethanol, 1,3-adamantanediethanol and hydroxyphenylcyclohexane. In the present invention, the above-described bisphenols preferably have at least one alkylene oxide group. Suitable examples of the alkylene oxide group include, but are not limited to, ethylene oxide and propylene oxide. The addition molar number thereof is preferably from 1 to 3. Within this range, the viscoelasticity or glass transition temperature of the polyester produced can be appropriately controlled for use as a toner.

Among the monomers described above, suitable monomers are hexanediol, cyclohexanediol, octanediol, decanediol, dodecanediol, bisphenol A, bisphenol C, bisphenol E, bisphenol S, bisphenol Z, and an alkylene oxide adduct of these bisphenols.

The polycondensation may also be performed by using a hydroxycarboxylic acid compound containing a carboxylic acid and a hydroxyl group within one molecule. Examples of such a compound include, but are not limited to, a hydroxyoctanoic acid, a hydroxynonanoic acid, a hydroxydecanoic acid, a hydroxyundecanoic acid, a hydroxydodecanoic acid, a hydroxytetradecanoic acid, a hydroxytridecanoic acid, a hydroxyhexadecanoic acid, a hydroxypentadecanoic acid and a hydroxystearic acid.

Furthermore, the polycondensation may also be performed by using a polyamine as the polycondensable monomer.

Examples of the polyamine include ethylenediamine, diethylenediamine, 1,2-propanediamine, 1,3-propanediamine, 1,4-butanediamine, 1,4-butenediamine, 2,2-dimethyl-1,3-butanediamine, 1,5-pentanediamine, 1,6-hexanediamine, 1,4-cyclohexanediamine and 1,4-cyclohexanebis (methylamine).

If desired, for the purpose of, for example, adjusting the acid value or hydroxyl group value, a monovalent acid such as acetic acid and benzoic acid, or a monohydric alcohol such as cyclohexanol and benzylalcohol may be used.

The polyester resin can be synthesized by selecting an arbitrary combination from the condensable monomer components described above and using a conventionally known method. A transesterification method, a direct polycondensation method and the like may be used individually or in combination.

In the polycondensation reaction at the production of a polycondensation resin, a polycondensation catalyst is preferably used, because the reaction rate can be increased.

In the polycondensation reaction, the reaction is preferably performed at a lower temperature than the conventional reaction temperature and this is very important for avoiding the conventional high energy consumption-type production process and reducing the resin production energy and toner production energy in terms of total meaning.

The reaction temperature at the polycondensation is preferably from about 70 to about 150° C., more preferably from about 70 to about 140° C., still more preferably from about 80° C. to less than about 140° C. If the reaction temperature is less than this range, reduction of reactivity, suppression of molecular weight extension, or the like may be caused due to decrease in the solubility of monomer or in the catalytic activity, whereas if it exceeds the temperature above, the consumption energy can be reduced and this is preferred. Furthermore, coloration of the resin, decomposition of the produced polycondensation resin, or the like may occur due to the high temperature. The reaction time at the polycondensation varies depending on the reaction temperature but is preferably from about 0.5 to about 72 hours, more preferably from about 1 to about 48 hours.

For polycondensing polycondensable monomers at a low temperature of about 150° C. or less (preferably about 100° C. of less), a polycondensation catalyst is usually used. As for the polycondensation catalyst having catalytic activity at a low temperature, an acid-based catalyst and a rare earth-containing catalyst may be used, and a hydrolase and the like may also be used.

The acid-based catalyst is preferably an acid-based catalyst showing Broensted acid-like acidity, and specific examples thereof include a sulfonic acid such as toluene-sulfonic acid, benzenesulfonic acid and camphorsulfonic acid, and an Na salt thereof.

Furthermore, an acid having a surface activating effect may also be used. The acid having a surface activating effect is an acid having a chemical structure comprising a hydrophobic group and a hydrophilic group and having an acid structure in which at least a part of the hydrophilic group comprises a proton.

Examples of the acid having a surface activating effect include an alkylbenzenesulfonic acid (e.g., dodecylbenzenesulfonic acid, isopropylbenzenesulfonic acid, camphorsulfonic acid), an alkylsulfonic acid, an alkyldisulfonic acid, an alkylphenolsulfonic acid, an alkylnaphthalenesulfonic acid, an alkyltetralinesulfonic acid, an alkylallylsulfonic acid, a petroleum sulfonic acid, an alkylbenzimidazolesulfonic acid, a higher alcohol ether sulfonic acid, an alkyldiphenylsulfonic acid, a higher fatty acid sulfuric ester (e.g., monobutyl-phenylphenol sulfuric acid, dibutyl-phenylphenol sulfuric acid, dodecylsulfuric acid), a higher alcohol sulfuric ester, a higher alcohol ether sulfuric ester, a higher fatty acid amidealkylol sulfuric ester, a higher fatty acid amidoalkylated sulfuric ester, a naphthenyl alcohol sulfuric acid, a sulfated fat, a sulfosuccinic acid ester, various fatty acids, a sulfonated higher fatty acid, a higher alkylphosphoric acid ester, a resin acid, a resin acid alcohol sulfuric acid, a naphthenic acid, a p-toluenesulfonic acid, and salt compounds of all of these acids. If desired, a plurality of species thereof may be used in combination.

As for the rare earth-containing catalyst, those containing scandium (Sc), yttrium (Y), lanthanum (La) as lanthanoid element, cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), lutetium (Lu) or the like are effective. In particular, those having an alkylbenzenesulfonate, alkylsulfuric ester salt or triflate structure are effective.

The rare earth-containing catalyst is preferably a rare earth-containing catalyst having a triflate structure such as scandium triflate, yttrium triflate and lanthanoid triflate. The lanthanoid triflate is described in detail in Journal of Synthetic Organic Chemistry, Japan, Vol. 53, No. 5, pp. 44-54. As for the triflate, examples of the structural formula include $X(OSO_2CF_3)_3$, wherein X is a rare earth element. Among these, X is preferably scandium (Sc), yttrium (Y), ytterbium (Yb), samarium (Sm) or the like.

The hydrolase is not particularly limited as long as it catalyzes an ester synthesis reaction. Examples of the hydrolase include an esterase classified into EC (enzyme code) group 3.1 (see, for example, Maruo and Tamiya (supervisors), Koso Handbook (Handbook of Enzyme), Asakura-Shoten (1982)) such as carboxyesterase, lipase, phospholipase, acetylesterase, pectinesterase, cholesterol esterase, tannase, monoacylglycerol lipase, lactonase and lipoprotein lipase; a hydrolase classified into EC group 3.2 having activity on a glycosyl compound, such as glucosidase, galactosidase, glucuronidase and xylosidase; a hydrolase classified into EC group 3.3 such as epoxide hydrase; a hydrolase classified into EC group 3.4 having activity on a peptide bond, such as aminopeptidase, chymotrypsin, trypsin, plasmin and subtilisin; and a hydrolase classified into EC group 3.7 such as phloretin hydrase.

Out of these esterases, an enzyme of hydrolyzing a glycerol ester and isolating a fatty acid is called a lipase. The lipase is advantageous in that, for example, this enzyme shows high stability in an organic solvent, catalyzes an ester synthesis reaction with good efficiency and is inexpensive. Accordingly, from the aspect of yield and cost, a lipase is preferably used also in the production process of a polyester of the present invention.

Lipases of various origins may be used, but preferred examples thereof include a lipase obtained from micro-organisms of *Pseudomonas* group, *Alcaligenes* group, *Achromobacter* group, *Candida* group, *Aspergillus* group, *Rhizopus* group and *Mucor* group, a lipase obtained from plant seeds and a lipase obtained from animal tissues, and further include pancreatin and steapsin. Among these, preferred is a lipase originated in microorganisms of *Pseudomonas* group, *Candida* group and *Aspergillus* group.

One of these polycondensation catalysts may be used alone or a plurality of species thereof may be used in combination. Furthermore, such a catalyst may be recovered and regenerated, if desired.

The polycondensation resin may be produced by a known polycondensation process such as bulk polymerization, emulsion polymerization, submerged polymerization (e.g., suspension polymerization), solution polymerization and interfacial polymerization, but submerged polymerization is preferred. Also, the reaction may be performed under atmospheric pressure, but when the purpose is, for example, to increase the molecular weight of the polycondensation resin such as polyester, general conditions such as reduced pressure or nitrogen stream can be widely employed.

The polycondensation reaction or the polymerization reaction described later may be performed by using an aqueous medium.

Examples of the aqueous medium which can be used in the present invention include water such as distilled water and ion exchanged water, and alcohols such as ethanol and methanol. Among these, ethanol and water are preferred, and water such as distilled water and ion exchanged water is more preferred. One of these aqueous mediums may be used alone or two or more species thereof may be used in combination.

Also, the aqueous medium may contain a water-miscible organic solvent. Examples of the water-miscible organic solvent include acetone and acetic acid.

The polycondensation reaction or the polymerization reaction described later may be performed by using an organic solvent.

Specific examples of the organic solvent which can be used in the present invention include a hydrocarbon-based solvent such as toluene, xylene, mesitylene; a halogen-based solvent such as chlorobenzene, iodobenzene, dichlorobenzene, 1,1,2,2-tetrachloroethane and p-chlorotoluene; a ketone-based solvent such as 3-hexanone, acetophenone and benzophenone; an ether-based solvent such as dibutyl ether, anisole, phenetole, o-dimethoxybenzene, p-dimethoxybenzene, 3-methoxytoluene, dibenzyl ether, benzyl phenyl ether, methoxynaphthalene and tetrahydrofuran; a thioether solvent such as phenyl sulfide and thioanisole; an ester-based solvent such as ethyl acetate, butyl acetate, pentyl acetate, methyl benzoate, methyl phthalate, ethyl phthalate and cellosolve acetate; and a diphenyl ether-based solvent such as diphenyl ether, an alkyl-substituted diphenyl ether (e.g., 4-methyl phenyl ether, 3-methyl phenyl ether, 3-phenoxytoluene), a halogen-substituted diphenyl ether (e.g., 4-bromophenyl ether, 4-chlorophenyl ether, 4-bromodiphenyl ether, 4-methyl-4'-bromodiphenyl ether), an alkoxy-substituted diphenyl ether (e.g., 4-methoxydiphenyl ether, 4-methoxyphenyl ether, 3-methoxyphenyl ether, 4-methyl-4'-methoxydiphenyl ether), and a cyclic diphenyl ether (e.g., dibenzofuran, xanthene). Some of these solvents may be used as a mixture. The solvent is preferably a solvent easily separable from water and for obtaining a polycondensation resin having a high average molecular weight, more preferably an ester-based solvent, an ether-based solvent or a diphenyl ether-based solvent, still more preferably an alkyl-aryl ether-based solvent or an ester-based solvent.

In the present invention, in order to obtain a polyester having a high average molecular weight, a dehydrating demonomerizing agent may be added to the organic solvent. Specific examples of the dehydrating demonomerizing agent include molecular sieves such as molecular sieve 3A, molecular sieve 4A, molecular sieve 5A, molecular sieve 13X, alumina, silica gel, calcium chloride, calcium sulfate, diphosphorus pentoxide, concentrated sulfuric acid, magnesium perchlorate, barium oxide, calcium oxide, potassium oxide, sodium oxide, a metal hydride such as calcium hydride, sodium hydride and lithium aluminum hydride, and an alkali metal such as sodium. Among these, molecular sieves are preferred because of easiness of handling and regeneration.

The weight average molecular weight of the polycondensation resin which can be used in the present invention is preferably from about 1,500 to about 60,000, more preferably from about 3,000 to about 40,000. The weight average molecular weight is preferably about 1,500 or more, because the cohesive force of the binder resin does not decrease and the hot offset property is good. Also, the weight average molecular is preferably about 60,000 or less, because the hot offset property is good and the minimum fixing temperature does not increase. The resin may be partially branched or crosslinked by, for example, selecting the carboxylic acid valence or alcohol valence of monomers.

As for the binder resin usable in the present invention, an addition polymerization-type resin is also useful. The addition-polymerizable monomer for use in the production of the addition polymerization-type resin includes a radical polymerizable monomer, a cationic polymerizable monomer and an anionic polymerizable monomer, and is preferably a radical polymerizable monomer, more preferably an ethylenically unsaturated monomer. Examples of the radical polymerization-type resin include a styrene-based resin and a (meth) acryl-based resin. In particular, a styrene-(meth)acryl-based copolymerization resin is preferred.

As for the styrene-(meth)acryl-based copolymerization resin, for example, a latex obtained by polymerizing a monomer mixture containing from about 60 to about 90 parts by weight of an ethylenically unsaturated group-containing aromatic monomer (styrene-based monomer), from about 10 to about 40 parts by mass of an ethylenically unsaturated carboxylic acid ester monomer ((meth)acrylic acid ester-based monomer), and from about 1 to about 3 parts by weight of an ethylenically unsaturated acid monomer, and dispersing and stabilizing the resulting copolymer with a surfactant, may be preferably used. The glass transition point of this copolymer is preferably from about 50 to about 70° C.

The polymerizable monomer which can be suitably used in the production of the binder resin usable in the present invention is described below.

Examples of the styrene-based monomer include styrene, vinylnaphthalene, an alkyl-substituted styrene having an alkyl chain, such as 2-methyl styrene, 3-methylstyrene, 4-methylstyrene, 2-ethylstyrene, 3-ethylstyrene and 4-ethylstyrene, a halogen-substituted styrene such as 2-chlorostyrene, 3-chlorostyrene and 4-chlorostyrene, and a fluorine-substituted styrene such as 4-fluorostyrene and 2,5-difluorostyrene. The styrene-based monomer is preferably styrene.

Examples of the (meth)acrylic acid ester-based monomer include n-methyl (meth)acrylate, n-ethyl (meth)-acrylate, n-propyl (meth) acrylate, n-butyl (meth) acrylate, n-pentyl (meth)acrylate, n-hexyl (meth)acrylate, n-heptyl (meth)acrylate, n-octyl (meth)acrylate, n-decyl (meth)-acrylate, n-dodecyl (meth)acrylate, n-lauryl (meth)acrylate, n-tetradecyl (meth)acrylate, n-hexadecyl (meth)acrylate, n-octadecyl (meth)acrylate, isopropyl (meth)acrylate, isobutyl (meth) acrylate, tert-butyl (meth)acrylate, isopentyl (meth)acrylate, amyl (meth)acrylate, neopentyl (meth)acrylate, isohexyl (meth)acrylate, isoheptyl (meth)acrylate, isooctyl (meth) acrylate, 2-ethylhexyl (meth)acrylate, phenyl (meth)acrylate, biphenyl (meth)-acrylate, diphenylethyl (meth)acrylate, tert-butylphenyl (meth)acrylate, terphenyl (meth)acrylate, cyclohexyl (meth) acrylate, tert-butylcyclohexyl (meth)acrylate, dimethylaminoethyl (meth)acrylate, diethylaminoethyl (meth)acrylate, methoxyethyl (meth)acrylate, 2-hydroxyethyl (meth)acrylate, β-carboxyethyl (meth)acrylate, (meth)-acrylonitrile and (meth)acrylamide. The (meth)acrylic acid ester-based monomer is preferably n-butyl acrylate.

The term "(meth)acrylic acid ester" as used herein is an abbreviating notation indicating that both structures of methacrylic acid ester and acrylic acid ester may be taken.

The ethylenically unsaturated acid monomer is an ethylenically unsaturated monomer containing an acidic group such as carboxyl group, sulfonic acid group and acid anhydride.

In the case of incorporating a carboxyl group into the styrene-based resin, (meth)acrylic acid ester-based resin or styrene-(meth)acrylic acid ester-based copolymerization resin, this may be attained by copolymerizing a carboxyl group-containing polymerizable monomer together.

Specific examples of the carboxyl group-containing polymerizable monomer include an acrylic acid, an aconitic acid, an atropic acid, an allylmalonic acid, an angelic acid, an isocrotonic acid, an itaconic acid, a 10-undecenoic acid, an elaidic acid, an erucic acid, an oleic acid, an ortho-carboxycinnamic acid, a crotonic acid, a chloroacrylic acid, a chloroisocrotonic acid, a chlorocrotonic acid, a chlorofumaric acid, a chloromaleic acid, a cinnamic acid, a cyclohexenedicarboxylic acid, a citraconic acid, a hydroxycinnamic acid, a dihydroxycinnamic acid, a tiglic acid, a nitrocinnamic acid, a vinylacetic acid, a phenylcinnamic acid, a 4-phenyl-3-butenoic acid, a ferulic acid, a fumaric acid, a brassidic acid, a 2-(2-furyl)acrylic acid, a bromocinnamic acid, a bromofumaric acid, a bromomaleic acid, a benzylidenemalonic acid, a benzoylacrylic acid, a 4-pentenoic acid, a maleic acid, a mesaconic acid, a methacrylic acid, a methyl-cinnamic acid and a methoxycinnamic acid. In view of the easiness of the polymer-forming reaction, an acrylic acid, a methacrylic acid, a maleic acid, a cinnamic acid and a fumaric acid are preferred, and an acrylic acid is more preferred.

The weight average molecular weight of the addition polymerization-type resin used as the binder resin is preferably from about 5,000 to about 50,000, more preferably from about 8,000 to about 40,000.

When the molecular weight is in the above-described range, this is preferred in that good powder characteristics of the toner can be kept at an ordinary temperature and the offset of the fixed image at high-temperature fixing can be prevented.

The glass transition point of the addition polymerization-type resin is preferably from about 45 to about 65° C., more preferably from about 50 to about 65° C.

When the glass transition point is in the above-described range, this is preferred in that the powder characteristics can be prevented from deterioration due to a releasing agent and the bleeding out of a releasing agent at the fixing can be facilitated.

The present invention may contain a polycondensation or polymerization reaction of the monomers with a previously produced prepolymer of a monomer. The prepolymer is not limited as long as it is a polymer capable of being melted or uniformly mixed in the monomers.

Furthermore, the binder resin usable in the present invention may contain, for example, a homopolymer of the above-described monomer, a copolymer comprising a combination of two or more monomers including the above-described monomers, or a mixture, graft polymer, partially branched or crosslinked structure thereof.

In the present invention, in the case of polymerizing a polycondensable monomer and a radical polymerizable monomer, the radical polymerizable monomer may be previously mixed with the polycondensation monomer at the polymerization step in an aqueous medium, and a hybrid particle comprising a polymer of those monomers may be finally obtained through polycondensation and radical polymerization.

Furthermore, in the polycondensation reaction, it is also possible to previously form a polymer having a low molecular weight by a block polymerization method or a solution polymerization method, emulsify or disperse the polymer in an aqueous medium, and perform a poly-condensation reaction to reach the final molecular weight. Also in this case, the emulsion-dispersion may be performed after the radical polymerizable monomer is mixed with the low molecular weight polycondensable resin or with the low molecular weight polycondensable resin and the polycondensable monomer.

In the polycondensation and/or polymerization in an aqueous medium of the present invention, the acid value of the resin affects the final molecular weight or the polymerization rate and therefore, a method of causing a radical polymerizable vinyl monomer or the like having low solubility in an aqueous medium to coexist during polycondensation, a method of previously adjusting the acid value to a lower state by preparing the polycondensable monomer in a low molecular weight form (or a medium molecular weight form) to such an extent as causing no trouble in the emulsion-dispersion, and then obtaining a final high molecular weight form in an aqueous medium, or a method using these two methods in combination, that is, a method where preliminary polymerization of a radical polymerizable monomer and preliminary polymerization of a polycondensable monomer are used in combination, may also be employed.

Similarly, in the polymerization of the present invention, a plurality of polymerizations may be performed simultaneously or successively. For example, a radical polymerizable monomer as a monomer component of undergoing the polymerization is mixed together with the polycondensation monomers, and the radical polymerization may be performed simultaneously with or after the polycondensation reaction, or inversely, the polycondensation may be performed after the radical polymerization. At this time, a polycondensation catalyst may be mixed in either the aqueous medium or the monomer component. Also, a radical polymerization catalyst (radical polymerization initiator) may be added in either the monomer mixture (oil phase) or aqueous medium. The radical polymerization initiator may be added before, during or after the polycondensation.

At the polycondensation or polymerization in an aqueous medium of the present invention, the monomer components before polycondensation may also be previously mixed with a colorant, a releasing agent, a fixing aid and other components generally required in the polymerization reaction or the production of toner, such as electrification aid and chain extending agent.

The binder resin usable in the present invention may use a chain transfer agent at the polymerization thereof.

The chain transfer agent is not particularly limited, but a compound having a thiol component may be preferably used. Specific preferred examples thereof include alkyl mercaptans such as hexyl mercaptan, heptyl mercaptan, octyl mercaptan, nonyl mercaptan, decyl mercaptan and dodecyl mercaptan. Use of a chain transfer agent is advantageous in that the molecular weight distribution of the binder resin becomes narrow and in turn, good storability of the toner at high temperatures is obtained.

The binder resin usable in the present invention may be formed as a crosslinked resin by adding a crosslinking agent, if desired. A representative crosslinking agent is a polyfunctional monomer having two or more ethylene-type polymerizable unsaturated groups within the molecule.

Specific examples of such a crosslinking agent include aromatic polyvinyl compounds such as divinylbenzene and divinylnaphthalene; polyvinyl esters of aromatic polyvalent carboxylic acid, such as divinyl phthalate, divinyl isophthalate, divinyl terephthalate, divinyl homophthalate, divinyl/trivinyl trimesate, divinyl naphthalenedicarboxylate and divinyl biphenylcarboxylate; divinyl esters of nitrogen-containing aromatic compound, such as divinyl pyridinedicarboxylate; vinyl esters of unsaturated heterocyclic compound-carboxylic acid, such as vinyl pyromucinate, vinyl furancarboxylate, vinyl pyrrole-2-carboxylate and vinyl thiophenecarboxylate; (meth)acrylic acid esters of linear polyhydric alcohol, such as butanediol methacrylate, hexanediol acrylate, octanediol methacrylate, decanediol acrylate and dodecanediol methacrylate; (meth)acrylic acid esters of branched substituted polyhydric alcohol, such as neopentyl glycol dimethacrylate and 2-hydroxy-1,3-diacryloxypropane; polyethylene glycol di(meth)acrylate and polypropylene polyethylene glycol di(meth)acrylate; and polyvinyl esters of polyvalent carboxylic acid, such as divinyl succinate, divinyl fumarate, vinyl/divinyl maleate, divinyl diglycolate, vinyl/divinyl itaconate, divinyl acetonedicarboxylate, divinyl glutarate, divinyl 3,3'-thiodipropionate, divinyl/trivinyl trans-aconitate, divinyl adipate, divinyl pimelate, divinyl suberate, divinyl azelate, divinyl sebacate, divinyl didodecanate and divinyl brassylate.

In the present invention, one of these crosslinking agents may be used alone, or two or more species thereof may be used in combination. Among those crosslinking agent, preferred as the crosslinking agent for use in the present invention are (meth)acrylic acid esters of linear polyhydric alcohol, such as butanediol methacrylate, hexanediol acrylate, octanediol methacrylate, decanediol acrylate and dodecanediol methacrylate; (meth)acrylic acid esters of branched substituted polyhydric alcohol, such as neopentyl glycol dimethacrylate and 2-hydroxy-1,3-diacryloxypropane; polyethylene glycol di(meth)acrylate and polypropylene polyethylene glycol di(meth)acrylate.

The content of the crosslinking agent is preferably from about 0.05 to about 5 wt %, more preferably from about 0.1 to about 1.0 wt %, based on the total amount of polymerizable monomers.

Out of the binder resins for use in the toner of the present invention, those capable of being produced by radical polymerization of polymerizable monomers may be polymerized by using a radical polymerization initiator.

The radical polymerization initiator used here is not particularly limited. Specific examples thereof include peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, diisopropyl peroxycarbonate, tetralin hydroperoxide, 1-phenyl-2-methylpropyl-1-hydroperoxide, tert-butylhydro-peroxide pert-riphenylacetate, tert-butyl performate, tert-butyl peracetate, tert-butyl perbenzoate, tert-butyl perphenylacetate, tert-butyl permethoxyacetate, and tert-butyl per-N-(3-toluyl)carbamate; azo compounds such as 2,2'-azobispropane, 2,2'-dichloro-2,2'-azobispropane, 1,1'-azo(methylethyl)diacetate, 2,2'-azobis(2-amidinopropane)-hydrochloride, 2,2'-azobis(2-amidinopropane)nitrate, 2,2'-azobisisobutane, 2,2'-azobisisobutylamide, 2,2'-azobis-isobutyronitrile, methyl 2,2'-azobis-2-methylpropionate, 2,2'-dichloro-2,2'-azobisbutane, 2,2'-azobis-2-methylbutyronitrile, dimethyl 2,2'-azobisisobutyrate, 1,1'-azobis(sodium 1-methylbutyronitrile-3-sulfonate), 2-(4-methylphenylazo)-2-methylmalonodinitrile, 4,4'-azobis-4-cyanovaleric acid, 3,5-dihydroxymethylphenylazo-2-methylmalonodinitrile, 2-(4-bromophenylazo)-2-allylmalonodinitrile, 2,2'-azobis-2-methylvaleronitrile, dimethyl 4,4'-azobis-4-cyanovalerate, 2,2'-azobis-2,4-dimethylvaleronitrile, 1,1'-azobiscyclohexanenitrile, 2,2'-azobis-2-propylbutyronitrile, 1,1'-azobis-1-chlorophenylethane, 1,1'-azobis-1-cyclohexanecarbonitrile, 1,1'-azobis-1-cycloheptanenitrile, 1,1'-azobis-1-phenylethane, 1,1'-azobiscumene, ethyl 4-nitrophenylazobenzylcyanoacetate, phenylazodiphenylmethane, phenylazotriphenylmethane, 4-nitrophenylazotriphenylmethane, 1,1'-azobis-1,2-diphenyl-ethane, poly(bisphenol A-4,4'-azobis-4-cyanopentanoate), and poly(tetraethylene glycol-2,2'-azobisisobutyrate); 1,4-bis(pentaethylene)-2-tetrazene, and 1,4-dimethoxycarbonyl-1,4-diphenyl-2-tetrazene.

In the case of performing the polycondensation and/or polymerization in an aqueous medium at the production of the binder resin, the method for forming a monomer particle emulsion include a method of uniformly mixing and emulsifying a monomer solution having added thereto a co-surfactant (oil phase) and an aqueous medium solution of surfactant (aqueous phase) in a shear mixing apparatus such as piston homogenizer, microfluidizing device (e.g., "Microfluidizer" manufactured by Microfluidics) and ultrasonic disperser. At this time, the amount of the oil phase charged in the aqueous phase is preferably on the order of 0.1 to 50 wt % based on the total amount of the aqueous phase and the oil phase. The amount of the surfactant used is preferably less than the critical micelle concentration (CMC) in the presence of the emulsion formed. Also, the amount of the co-surfactant used is preferably from about 0.1 to about 40 parts by weight, more preferably from about 0.1 to about 20 parts by weight, per 100 parts by weight of the oil phase.

Incidentally, a "miniemulsion polymerization method", which is the polymerization of monomers of a monomer emulsion obtained by using, as described above, a surfactant in an amount less than the critical micelle concentration (CMC) and a co-surfactant in combination, is preferred because the addition-polymerizable monomer is polymerized in a monomer particle (oil droplet) and therefore, a uniform polymer particle is formed. Furthermore, in the present invention, the "miniemulsion polymerization method" is advantageous also for the polymerization of a polycondensable/addition-polymerization composite polymer, because the monomer needs not to diffuse in the polymerization process and therefore, the poly-condensable polymer can be present as it is in the polymer particle.

A so-called "microemulsion polymerization method" of producing particles having a particle diameter of 5 to 50 nm described, for example, in J. S. Guo, M. S. El-Aasser, and J. W. Vanderhoff, J. Polym. Sci.: Polym. Chem. Ed., Vol. 27, page 691 (1989) has the same dispersion structure and the same polymerization mechanism as those of the "miniemulsion polymerization method" referred to in the present invention, and this polymerization method may be employed in the present invention. In the "microemulsion polymerization", a surfactant is used in a large amount more than the critical micelle concentration (CMC) and this may cause a problem. For example, a surfactant in a large amount may be mingled into the obtained polymer particle or a huge time is necessary for the step of removing the mingled surfactant, such as water washing, acid washing or alkali washing.

In the case of performing the polycondensation and/or polymerization in an aqueous medium at the production of the binder resin, a co-surfactant is preferably used. The co-surfactant is more preferably used in an amount of about 0.1 to about 40 wt % based on the total amount of monomers. The co-surfactant is added to reduce the Ostwald ripening in the so-called miniemulsion polymerization. As for the co-surfactant, those generally known as a co-surfactant for the miniemulsion method may be used.

Suitable examples of the co-surfactant include, but are not limited to, alkanes having a carbon number of 8 to 30, such as dodecane, hexadecane and octadecane; alkyl alcohols having a carbon number of 8 to 30, such as lauryl alcohol, cetyl alcohol and stearyl alcohol; alkyl mercaptans having a carbon number of 8 to 30, such as lauryl mercaptan, cetyl mercaptan and stearyl mercaptan; acrylic acid esters, methacrylic acid esters, and polymers thereof; polymers or polyadducts such as polystyrene and polyester; carboxylic acids; ketones; and amines.

Among these co-surfactants, preferred are hexadecane, cetyl alcohol, stearyl methacrylate, lauryl methacrylate, polyester and polystyrene. In particular, for the purpose of avoiding the generation of a volatile organic substance, stearyl methacrylate, lauryl methacrylate, polyester and polystyrene are more preferred:

The polymer or polymer-containing composition which can be used for the co-surfactant may contain, for example, a copolymer, block copolymer or mixture with another monomer. Furthermore, a plurality of co-surfactants may also be used in combination.

In the production of the toner of the present invention, a surfactant may be used, for example, for the purpose of stabilization at the dispersion in the suspension polymerization method, or dispersion stabilization of a resin particle liquid dispersion, a colorant liquid dispersion, a releasing agent liquid dispersion or the like in the emulsion-polymerization aggregation method.

Examples of the surfactant include an anionic surfactant such as sulfuric ester salt type, sulfonate type, phosphoric ester type and soap type; a cationic surfactant such as amine salt type and quaternary ammonium salt type; and a nonionic surfactant such as polyethylene glycol type, alkyl phenol ethylene oxide adduct type and polyhydric alcohol type. Among these, an ionic surfactant is preferred, and an anionic surfactant and a cationic surfactant are more preferred.

In the toner of the present invention, an anionic surfactant generally exerts strong dispersion force and provides excellent dispersion of a resin particle or a colorant. Furthermore, an anionic surfactant is advantageous as the surfactant for dispersing a releasing agent.

The nonionic surfactant is preferably used in combination with the above-described anionic or cationic surfactant. One of those surfactants may be used alone, or two or more species thereof may be used in combination.

Specific examples of the anionic surfactant include fatty acid soaps such as potassium laurate, sodium oleate and sodium castor oil; sulfuric acid esters such as octyl sulfate, lauryl sulfate, lauryl ether sulfate and nonyl phenyl ether sulfate; sodium alkylnaphthalenesulfonate such as lauryl sulfonate, dodecylbenzene sulfonate, triisopropylnaphthalene sulfonate and dibutylnaphthalene sulfonate; sulfonates such as naphthalene sulfonate formalin condensate, monooctyl sulfosuccinate, dioctyl sulfosuccinate, lauric acid amide sulfonate, and oleic acid amide sulfonate; phosphoric acid esters such as lauryl phosphate, isopropyl phosphate and nonyl phenyl ether phosphate; dialkyl sulfosuccinates such as sodium dioctylsulfosuccinate; and sulfosuccinates such as disodium lauryl sulfosuccinate.

Specific examples of the cationic surfactant include amine salts such as laurylamine hydrochloride, strearylamine hydrochloride, oleylamine acetate, stearylamine acetate and stearylaminopropylamine acetate; and quaternary ammonium salts such as lauryltrimethylammonium chloride, dilauryldimethylammonium chloride, distearyldimetylammonium chloride, distearyldimetylammonium chloride, lauryldihydroxyethylmethylammonium chloride, oleylbispolyoxyethylenemethylammonium chloride, lauroylaminopropyldimethylethylammonium ethosulfate, lauroylaminopropyldimethylhydroxyethylammonium perchlorate, alkylbenzenetrimethylammonium chloride and alkyltrimethylammonium chloride.

Specific examples of the nonionic surfactant include alkyl ethers such as polyoxyethylene octyl ether, polyoxyethylene lauryl ether, polyoxyethylene stearyl ether and polyoxyethylene oleyl ether; alkyl phenyl ethers such as polyoxyethylene octyl phenyl ether and polyoxyethylene nonyl phenyl ether; alkyl esters such as polyoxyethylene laurate, polyoxyethylene stearate and polyoxyethylene oleate; alkylamines such as polyoxyethylene laurylamino ether, polyoxyethylene stearylamino ether, polyoxyethylene oleylamino ether, polyoxyethylene soybean amino ether and polyoxyethylene beef tallow amino ether; alkyl amides such as polyoxyethylene lauric acid amide, polyoxyethylene stearic acid amide and polyoxyethylene oleic acid amide; vegetable oil ethers such as polyoxyethylene castor oil ether and polyoxyethylene rape-seed oil ether; alkanol-amides such as lauric acid diethanolamide, stearic acid diethanolamide and oleic acid-diethanolamide; and sorbitan ester ethers such as polyoxyethylene sorbitan monolaurate, polyoxyethylene sorbitan monopalmitate, polyoxyethylene sorbitan monostearate and polyoxyethylene sorbitan monooleate.

The content of the surfactant in each liquid dispersion is sufficient if it is on the order of hot inhibiting the present invention. The surfactant content is generally a small amount, specifically, from about 0.01 to about 3 wt %, preferably from about 0.05 to about 2 wt %, still more preferably from about 0.1 to about 2 wt %. When the surfactant content is in this range, the liquid dispersions such as resin particle liquid dispersion, colorant liquid dispersion and releasing agent liquid dispersion each can be stable, aggregation or isolation of a specific particle does not occur, the amount added of the calcium compound is not affected, and the effects of the present invention can be satisfactorily obtained. In general, a dispersion of suspension-polymerization toner having a large particle diameter is stable even when the amount of the surfactant used is small.

As for the dispersion stabilizer used in the suspension polymerization method and the like, a sparingly water-soluble hydrophilic inorganic particle may be used. Examples of the inorganic particle which can be used include silica, alumina, titania, calcium carbonate, magnesium carbonate, tricalcium phosphate (hydroxyapatite), clay, diatomaceous earth and bentonite. Among these, calcium carbonate and tricalcium phosphate are preferred because the particle size formation of particles is facilitated and the removal is easy.

In addition, an aqueous polymer or the like which is solid at an ordinary temperature may also be used as the dispersion stabilizer. Specifically, a cellulose-based compound such as carboxymethylcellulose and hydroxypropyl-cellulose, polyvinyl alcohol, gelatin, starch, gum arabic and the like can be used.

<Electric Charge Control Agent>

In the toner of the present invention, an electric charge control agent may be added, if desired.

As for the electric charge control agent, a known electric charge control agent may be used, and an azo-based metal complex compound, a metal complex compound of salicylic acid, and a resin-type electric charge control agent having a polar group may be used. In the case of producing the toner by a wet production process, a material hardly dissolvable in water is preferably used from the standpoint of controlling the ion intensity (%) and reducing the waste water contamination. Incidentally, the toner of the present invention may be either a magnetic toner containing a magnetic material or a non-magnetic toner not containing a magnetic material.

<Aggregating Agent>

In the case of using an emulsion-aggregation-coalescence method for the production of the toner of the present invention, aggregation may be generated by the pH change in the aggregation step to produce particles.

The aggregating agent is preferably a compound having a monovalent or more electric charge, and specific examples thereof include water-soluble surfactants such as ionic surfactants and nonionic surfactants described above; acids such as hydrochloric acid, sulfuric acid, nitric acid, acetic acid and oxalic acid; a metal salt of inorganic acid, such as magnesium chloride, sodium chloride, aluminum sulfate, calcium sulfate, ammonium sulfate, aluminum nitrate, silver nitrate, copper nitrate and sodium carbonate; a metal salt of aliphatic acid or aromatic acid, such as sodium acetate, potassium formate, sodium oxalate, sodium phthalate and potassium salicylate; a metal salt of phenols, such as sodium phenolate; a metal salt of amino acid; and inorganic acid salts of aliphatic or aromatic amines, such as triethanol amine hydrochloride and aniline hydrochloride.

When the stability of aggregate particle, the stability of aggregating agent against heat or aging and the removal at the washing are taken into consideration, the aggregating agent is preferably a metal salt of inorganic acid in view of performance and use. Specific examples thereof include a metal salt of inorganic acid, such as magnesium chloride, sodium chloride, aluminum sulfate, ammonium sulfate, aluminum nitrate, silver nitrate, copper sulfate and sodium carbonate.

The amount of the aggregating agent added varies depending on the valence of the electric charge but is small in any case, specifically, about 3 wt % or less in the case of monovalent, about 1 wt % or less in the case of divalent, and about 0.5 wt % or less in the case of trivalent, based on the entire amount of the toner. Since the amount of the aggregating agent is preferably smaller, a compound having a large valence is preferably used.

<Colorant>

The colorant usable in the present invention is not particularly limited and includes known colorants, and an appropriate colorant may be selected according to the purpose. One colorant may be used alone, two or more colorants of the same series may be used as a mixture, or two or more colorants of different series may be used as a mixture. Such a colorant may be surface-treated before use.

Specific examples of the colorant include the following black, yellow, orange, red, blue, violet, green and white-type colorants.

Examples of the black pigment include an organic or inorganic colorants such as carbon black, aniline black, active carbon, non-magnetic ferrite and magnetite.

Examples of the yellow pigment include chrome yellow, zinc yellow, yellow calcium oxide, cadmium yellow, chromium yellow, Fast Yellow, Fast Yellow 5G, Fast Yellow 5GX, Fast Yellow 10G, Benzidine Yellow G, Benzidine Yellow GR, Threne Yellow, Quinoline Yellow and Permanent Yellow NCG.

Examples of the orange pigment include red chrome yellow, Molybdenum Orange, Permanent Orange GTR, Pyrazolone Orange, Vulcan Orange, Benzidine Orange G, Indantherene Brilliant Orange RK and Indantherene Brilliant Orange GK.

Examples of the red pigment include iron red, cadmium red, red lead, mercury sulfide, Watchung Red, Permanent Red 4R, Lithol Red, Brilliant Carmine 3B, Brilliant Carmine 6B, DuPont Oil Red, pyrazolone red, Rhodamine B Lake, Lake Red C, Rose Bengal, Eoxine Red and Alizarin Lake.

Examples of the blue pigment include organic or inorganic colorants such as Prussian Blue, cobalt blue, Alkali Blue Lake, Victoria Blue Lake, Fast Sky Blue, Indanthrene Blue BC, Ultramarine Blue, Phthalocyanine Blue and Phthalocyanine Green.

Examples of the violet pigment include organic or inorganic colorants such as manganese violet, Fast Violet B and Methyl Violet Lake.

Examples of the green pigment include organic or inorganic colorants such as chromium oxide, chromium green, Pigment Green B, Malachite Green Lake and Final Yellow Green G.

Examples of the white pigment include zinc white, titanium oxide, antimony white and zinc sulfide.

Examples of the extender pigment include barite powder, barium carbonate, clay, silica, white carbon, talc and white alumina.

<Dispersion Method of Colorant>

The colorant for use in the toner of the present invention may be dispersed in the binder resin by using a known method. In the case of producing the toner by a kneading pulverization method, the colorant may be used as it is, or a so-called masterbatch which is previously dispersed in a resin to a high concentration and kneaded together with the binder resin at the kneading may be used. Furthermore, a flushing process of synthesizing a colorant and then dispersing the colorant in the wet cake state before drying in a resin may also be employed.

The colorant may be used as it is when producing the toner by a suspension polymerization method. In the suspension polymerization method, the colorant dispersed in a resin may be dissolved or dispersed in the polymerizable monomer, whereby the colorant can be dispersed in the granulated particle.

In the case of producing the toner by an emulsion-polymerization aggregation method, the colorant is dispersed together with a dispersant such as surfactant in an aqueous medium by using a mechanical impact or the like, thereby preparing a colorant liquid dispersion, and the colorant liquid dispersion is aggregated together with a resin particle and the like and granulated into a toner particle diameter, whereby the toner can be obtained.

In dispersing the colorant by mechanical impact or the like, a colorant particle liquid dispersion may be prepared specifically, for example, by using a rotary shear homogenizer, a media-type disperser such as ball mill, sand mill and attritor, or a high-pressure counter-collision disperser. The colorant may also be dispersed in an aqueous system by a homogenizer with use of a surfactant having polarity.

In order to ensure the coloration at the fixing, the colorant is preferably added in an amount of about 4 to about 15 wt %, more preferably from about 4 to about 10 wt %, based on the total weight as a solid content of the toner. However, in the case of using a magnetic material as the black colorant, the colorant is preferably added in the range of about 12 to about 48 wt %, more preferably from about 15 to about 40 wt %. By appropriately selecting the kind of the colorant, a color toner such as yellow toner, magenta toner, cyan toner, black toner, white toner and green toner can be obtained.

<Releasing Agent>

In the toner of the present invention, a releasing agent may be added, if desired. The releasing agent is generally used for enhancing the releasability.

Specific examples of the releasing agent include low molecular weight polyolefins such as polyethylene, polypropylene and polybutene; silicones having a softening point softening under heating; fatty acid amides such as oleic acid amide, erucic acid amide, ricinoleic acid amide and stearic acid amide; a vegetable wax such as carnauba wax, rice wax, candelilla wax, Japan wax and jojoba oil; an animal wax such as bees wax; a mineral or petroleum wax such as montan wax, ozokerite, ceresin, paraffin wax, microcrystalline wax and Fischer-Tropsch wax; and an ester-based wax such as fatty acid ester, montanic acid ester and carboxylic acid ester. In the present invention, one of these releasing agents may be used alone, or two or more species thereof may be used in combination.

The amount of the releasing agent added is preferably from about 1 to about 20 wt %, more preferably from about 5 to about 15 wt %, based on the entire amount of the toner particle. Within this range, the effect of the releasing agent is satisfactorily obtained, and the toner particle is not easily broken in a developing machine, ensuring that the releasing agent is not spent on a carrier and the electric charge hardly decreases. Therefore, the above-described range is preferred.

<Dispersing Method of Releasing Agent>

The releasing agent for use in the toner of the present invention can be dispersed in the binder resin y using a known method. In the production of the toner by a suspension polymerization, the releasing agent may be used as it is, but the releasing agent dispersed in a resin may be dissolved or dispersed in the polymerizable monomer, whereby the colorant can be dispersed in the granulated particle.

In the case of producing the toner by an emulsion-polymerization aggregation method, the releasing agent is dispersed together with a dispersant such as surfactant in an aqueous medium by using a mechanical shearing force or the like, thereby preparing a releasing agent liquid dispersion, and the releasing agent liquid dispersion is aggregated together with a resin particle and the like and granulated into a toner particle diameter, whereby the toner can be obtained.

In dispersing the releasing agent by mechanical shearing force or the like, for example, a liquid dispersion of releasing agent particles may be prepared by using a rotary shear homogenizer, a media-type disperser such as ball mill, sand mill and attritor, or a high-pressure counter-collision disperser.

<Magnetic Material>

The electrostatic image developing toner of the present invention may contain a magnetic material, if desired.

The magnetic material includes a metal exhibiting strong ferroelectric property, such as iron (including ferrite and magnetite), cobalt and nickel, an alloy or compound containing such an element; an alloy which contains no ferromagnetic element but exhibits ferro-magnetic property when subjected to an appropriate heat treatment, for example, an alloy called Heusler alloy and containing manganese and copper, such as manganese-copper-aluminum and manganese-copper-tin; chromium dioxide; and others. For example, in the case of obtaining a black toner, magnetite which itself is black and also exerts a function as the colorant may be preferably used. In the case of obtaining a color toner, a magnetic material with less black tinting, such as metallic iron, is preferred. Some of these magnetic materials also fulfill a function as the colorant and in such a case, the magnetic material may be used to serve also as a colorant. The content of the magnetic material is, in the case of producing a magnetic toner, preferably from about 20 to about 70 parts by weight, more preferably from about 40 to about 70 parts by weight, per 100 parts by weight of the toner.

<Internal Additive>

In the toner of the present invention, an internal additive may be added inside the toner. The internal additive is generally used for the purpose of controlling the viscoelasticity of the fixed image.

Specific examples of the internal additive include an inorganic particle such as silica and titania, and an organic particle such as polymethyl methacrylate. The internal additive may be surface-treated for enhancing the dispersibility. One of these internal additives may be used alone, or two or more species thereof may be used in combination.

<External Additive>

The toner of the present invention may be subjected to a treatment of adding an external additive such as fluidizing agent and electric charge control agent.

As for the external additive, a known material such as a silica particle with the surface being treated with a silane coupling agent or the like, an inorganic particle (e.g., titanium oxide particle, alumina particle, cerium oxide particle, carbon black), a polymer particle (e.g., polycarbonate, polymethyl methacrylate, silicone resin), an amine metal salt, a salicylic acid metal complex, may be used. One of the external additives which can be used in the present invention may be used alone, or two or more species thereof may be used in combination.

The toner of the present invention preferably has an accumulated volume average particle diameter $D_{50}$ of about 3.0 to about 9.0 μm, more preferably from about 3.0 to about 5.0 μm. $D_{50}$ is preferably about 3.0 μm or more, because appropriate adhesive force and good developability are obtained. Also, $D_{50}$ is preferably about 9.0 μm or less, because excellent image resolution is obtained.

Furthermore, the toner of the present invention preferably has a volume average particle size distribution index GSDv of about 1.30 or less. When GSDv is about 1.30 or less, good resolution, less occurrence of toner flying, fogging or the like, and less production of image defect are advantageously ensured.

As for the accumulated volume average particle diameter $D_{50}$ or average particle size distribution index of the toner of the present invention, when an accumulated distribution of each of the volume and the number is drawn from the small diameter side with respect to the particle size range (channel) divided on the basis of particle size distribution measured by a measuring device such as Coulter Counter TAII, (manufactured by Beckman Coulter Inc.) and Multisizer II (manufactured by Beckman Coulter Inc.), the particle diameter at 16% accumulation is defined as $D_{16V}$ by volume, the particle diameter at 50% accumulation is defined as $D_{50V}$ by volume, and the particle diameter at 84% accumulation is defined as $D_{84V}$ by volume. Using these, the volume average particle size distribution index (GSDv) is calculated by $(D_{84v}/D_{16v})^{1/2}$.

The shape factor SF1 of the toner is preferably from about 110 to about 140, more preferably from about 120 to about 140. In the electrophotographic process, it is known that a higher spherical toner is more easily transferred at the transfer step, and a higher amorphous toner is more easily cleaned at the cleaning step.

SF1 is a shape factor showing the degree of irregularities on the toner particle surface and calculated as follows. An optical microscopic image of the toner scattered on a slide glass is input into a Luzex image analyzer through a video camera and from a square of maximum length of toner particle/projected area ($(ML)^2/A$) of 50 toner particles, SF1 is calculated according to the following formula, and its average value is determined to obtain the toner shape factor SF1.

$$SF1 = \frac{(ML)^2}{A} \times \frac{\pi}{4} \times 100$$

wherein ML is a maximum length of the toner particle and A is a projected area of the toner particle.

(Production Method of Electrostatic Image Developing Toner)

As for the production method of the electrostatic image developing toner of the present invention, a toner may be produced by a mechanical production process such as pulverization, or by a so-called chemical production process of producing a resin particle liquid dispersion by using the binder resin, and producing a toner from the resin particle liquid dispersion. The toner of the present invention may be a so-called pulverization toner or a polymerization toner, but is preferably a polymerization toner.

The production method of the electrostatic image developing toner of the present invention is not particularly limited as long as it is a known method such as a kneading pulverization method, emulsion-polymerization aggregation method and suspension polymerization method, but an emulsion-polymerization aggregation method is preferred.

The production method of the electrostatic image developing toner of the present invention is preferably a method comprising at least a step of aggregating a binder resin particle and an amide ester represented by formula (1) in a liquid dispersion containing the resin particle and the amide ester (hereinafter sometimes referred to as an "aggregation step"), and a step of heating and coalescing the aggregate particles (hereinafter sometimes referred to as a "coalescence step").

In the aggregation step, the amide ester represented by formula (1) may be mixed simultaneously or successively with the binder resin or other components. Alternatively, the amide ester represented by formula (1) may be mixed with the binder resin at the production of the binder resin, and the binder resin may be used as an amide ester-containing binder resin.

In the emulsion-polymerization aggregation method, the amide ester represented by formula (1) is preferably added simultaneously with an emulsifier. In the pulverization method, the amide ester represented by formula (1) is preferably added simultaneously with a colorant.

In the aggregation step, the binder resin is preferably used in the form of a binder resin particle liquid dispersion.

The method for dispersing the binder resin in an aqueous medium and forming the dispersion into particles may also be selected known methods such as forced emulsification method, self-emulsification method and phase-inversion emulsification method. Among these, a self-emulsification method and a phase-inversion emulsification method are preferred in view of the energy required for emulsification, controllability of particle diameter of the resulting emulsified product, safety and the like.

The self-emulsification method and phase-inversion emulsification method are described in Chobiryushi Polymer no Oyo Gijutsu (Applied Technology of Ultrafine Particulate Polymer), CMC. As for the polar group used in the self-emulsification method, a carboxyl group, a sulfone group or the like may be used.

In the case of using an organic solvent at the production of the resin particle liquid dispersion, the resin particle is preferably formed by removing a part of the organic solvent.

For example, the binder resin-containing material after emulsification is preferably solidified as a particle by removing a part of the organic solvent. Specific examples of the method for solidification include a method of emulsion-dispersing a polycondensation resin-containing material in an aqueous medium, and then drying the organic solvent at the air-liquid interface by feeding air or an inert gas such as nitrogen while stirring the solution (waste air drying method), a method of performing the drying by keeping the system under reduced pressure while, if desired, bubbling an inert gas (vacuum topping method), and a method of repeatedly ejecting an emulsion-dispersion liquid after the emulsion dispersion of a polycondensation resin-containing material in an aqueous medium or an emulsified liquid of the polycondensation resin-containing material to emerge in the form of a shower from small pores and fall on a dish-like receiver or the like, thereby performing the drying (shower-type solvent removal method). The removal of solvent is preferably performed by appropriately selecting these methods individually or in combination according to the evaporation rate, solubility in water or the like of the organic solvent used.

The median diameter (center diameter) of the resin particle liquid dispersion is preferably from about 0.05 to about 2.0 μm, more preferably from about 0.1 to about 1.5 μm, still more preferably from about 0.1 to about 1.0 μm. When the median diameter is in this range, the dispersion state of resin particles in an aqueous medium is stabilized as described above and this is preferred. Also, when used for the production of the toner, the particle diameter can be easily controlled and excellent releasability or high offset resistance can be advantageously obtained at the fixing.

The median diameter of the resin particle can be measured, for example, by a laser diffraction-type particle size distribution measuring device (LA-920, manufactured by Horiba Ltd.).

In the aggregation step, the aggregation method is not particularly limited, and an aggregation method conventionally employed in the emulsion polymerization-aggregation of an electrostatic image developing toner, such as a method of reducing the stability of emulsion, for example, by the elevation of temperature, change of pH or addition of salt and then stirring the emulsion with a disperser or the like, may be used.

In the aggregation step, for example, respective particles in the resin particle liquid dispersion, the colorant liquid dispersion and, if desired, the releasing agent liquid dispersion, which are mixed with each other, are aggregated, whereby an aggregate particle having a toner particle diameter can be formed. The aggregate particle is formed by the hetero-aggregation or the like, or an ionic surfactant having polarity different from that of the aggregate particle or a compound having a monovalent or greater valent electric charge, such as metal salt, may be added for the purpose of stabilizing the aggregate particle or controlling the particle size/particle size distribution.

In the aggregation step, the toner particle diameter and distribution can be controlled by performing the aggregation (association), for example, by a known method where the oil droplet emulsion-dispersed in an aqueous phase is formed into a resin polymer particle by polymerizing the monomers in the oil droplet in the presence of a polymerization initiator, and the polymer particles formed, particles containing at least a colorant particle (in the case where the colorant is previously added to the resin in the polymerization step, the particle itself is a colored particle), are aggregated (associated). Preferably, production of a toner particle by the emulsion-polymerization aggregation method is used. More specifically, the resin particle liquid dispersion produced is mixed with the amide ester represented by formula (1), the colorant particle liquid dispersion, the releasing agent particle liquid dispersion and the like, an aggregating agent is added to cause hetero-aggregation and thereby form an aggregate particle having a toner size, and the aggregate particles are fused and coalesced under heating to a temperature higher than the glass transition point or melting point of the resin particle, then washed and dried to obtain a toner. In this production method, the toner shape from amorphous to spherical can be controlled by selecting the heating temperature condition.

In the aggregation step, aggregation and subsequent procedure may also be performed by mixing two or more kinds of resin particle liquid dispersions. At this time, a particle having a multilayer structure may also be produced by previously aggregating a resin particle liquid dispersion to form a first aggregate particle, and adding another resin particle liquid dispersion to form a second shell layer on the surface of the first aggregate particle. Needless to say, a multilayer particle may also be produced by the additions in the reverse order from the above-described example.

After the aggregation treatment, the particle surface may be crosslinked by applying a heat treatment or the like for the purpose of, for example, suppressing the bleed-out of the colorant from the particle surface. The surfactant and the like used may be removed by washing such as water washing, acid washing or alkali washing, if desired.

In the coalescence step, the binder resin in the aggregate particle is melted under the temperature condition higher than the melting point or glass transition point of the resin, and the aggregate particle changes from amorphous to spherical. Thereafter, the aggregate is separated from the aqueous medium and, if desired, washed and dried, whereby a toner particle is formed.

After the completion of aggregation and coalescence steps, a washing step, a solid-liquid separation step and a drying step may be arbitrarily performed to obtain a desired toner particle. In view of chargeability, the washing step is preferably performed by thorough displacement and washing with ion exchanged water. The solid-liquid separation step is not particularly limited but in view of productivity, suction filtration, pressure filtration or the like is preferably used. The drying step is also not particularly limited but in view of productivity, freeze drying, flash jet drying, fluidized drying, vibration-type fluidized drying and the like are preferred.

The pulverization toner may be produced by a known method, for example, by a kneading pulverization method.

In the case of producing a pulverization toner by a kneading pulverization method, the binder resin produced as above is preferably stirred and mixed with other toner raw materials in a Henschel mixer, a super mixer or the like before the melt kneading. At this time, the capacity of stirrer, the rotation speed of stirrer, the stirring time and the like must be selected in combination.

The stirred product of the binder resin and other toner raw materials is then kneaded in the melted state by a known method. Kneading by a single-screw or multiple-screw extruder is preferred, because the dispersibility is enhanced. At this time, the number of kneading screw zones, the cylinder temperature, the kneading speed and the like of the kneading apparatus must be set to appropriate values and controlled. Out of the controlling factors at the kneading, particularly, the rotation number of kneader, the number of kneading screw zones and the cylinder temperature have great effect on the kneaded state. In general, the rotation number is preferably from 300 to 1,000 rpm and as for the number of kneading screw zones, kneading is more successfully performed by using a multi-stage zone such as two-stage screw, than using a one-stage zone. The cylinder preset temperature is, when the main component of the resin particle is a non-crystalline polyester, determined by the softening point of the non-crystalline polyester and usually, this temperature is preferably on the order of −20 to +100° C. of the softening temperature. When the cylinder preset temperature is in the above-described range, this is preferred in that satisfactory kneading-dispersion is obtained, aggregation less occurs, kneading shear is applied, and sufficient dispersion and cooling after kneading are facilitated.

The kneaded product after melt-kneading is thoroughly cooled and then pulverized by a known method such as mechanical pulverization method (e.g., ball mill, sand mill, hammer mill) or airflow pulverization method. In the case where satisfactory cooling cannot be performed by a normal method, a cooling or freeze pulverization method may also be selected.

For the purpose of controlling the toner particle size distribution, the toner after pulverization is sometimes classified. Classification to remove particles having an improper diameter provides an effect of enhancing the fixing property of toner or the image quality.

(Electrostatic Image Developer)

The electrostatic image developing toner described above of the present invention may be used as an electrostatic image developer. This developer is not particularly limited except for containing the electrostatic image developing toner and may take an appropriate component composition according to the purpose. When the electrostatic image developing toner is used alone, as a one-component system electrostatic image developer is prepared, and when used in combination with a carrier, a two-component system electrostatic image developer is prepared.

The carrier which can be used in the present invention is not particularly limited, but examples of the carrier usually employed include a magnetic particle such as iron powder, ferrite, iron oxide powder and nickel; a resin-coated carrier obtained by coating the surface of a magnetic particle as a core material with a resin such as styrene-based resin, vinyl-based resin, ethylene-based resin, rosin-based resin, polyester-based resin and melamine-based resin or with a wax such as stearic acid to form a resin coat layer; and a magnetic material dispersion-type carrier obtained by dispersing magnetic particles in a binder resin. Among these, a resin-coated carrier is preferred, because the chargeability of the toner or the resistance of the entire carrier can be controlled by the constitution of the resin coat layer.

The mixing ratio between the toner of the present invention and the carrier in the two-component system electrostatic image developer is usually from about 2 to about 10 parts by weight of toner per 100 parts by weight of carrier. The preparation method of the developer is not particularly limited, but examples thereof include a method of mixing the toner and the carrier by a V blender.

(Image Forming Method)

The image forming method of the present invention is an image forming method comprising a latent image forming step of forming an electrostatic latent image on the surface of a latent image-holding member, a development step of developing the electrostatic latent image formed on the surface of the latent image-holding member with a toner-containing developer to form a toner image, a transfer step of transferring the toner image formed on the surface of the latent image-holding member to the surface of a transferee member, and a fixing step of heat-fixing the toner image transferred to the surface of the transferee member, wherein the toner is the electrostatic image developing toner of the present invention or the developer is the electrostatic image developer of the present invention.

In the image forming method of the present invention, a developer is prepared by using a specific toner described above, an electrostatic image is formed and developer by using the developer in a normal electrophotographic copying machine, and the toner image obtained is electrostatically transferred onto a transfer paper and then fixed by a heat roller fixing device at a heat roller temperature set to a constant temperature, whereby a copy image is formed.

The image forming method of the present invention is preferably used particularly when performing high-speed fixing such that the contact time between the toner on the transfer paper and the heat roller is within about 1 second, more preferably within about 0.5 seconds.

The electrostatic image developer (electrostatic image developing toner) of the present invention may also be used for the image forming method in a normal electrostatic image developing system (electrophotographic system). The image forming method of the present invention specifically comprises, for example, an electrostatic latent image forming step, a toner image forming step, a transfer step and a cleaning step. These steps each is itself a general step and are described, for example, in JP-A-56-40868 and JP-A-49-91231. Incidentally, the image forming method of the present invention may be performed by using a known image forming apparatus such as copying machine and facsimile machine.

The electrostatic latent image forming step is a step of forming an electrostatic latent image (electrostatic image) on an electrostatic image carrying member. The toner image forming step is a step of developing the electrostatic latent image with a developer layer on a developer-carrying member to form a toner image. The developer layer is not particularly limited as long as it contains the electrostatic image developer of the present invention containing the electrostatic image developing toner of the present invention. The transfer step is a step of transferring the toner image on a transfer material. The cleaning step is a step of removing the electrostatic image developer remaining on the electrostatic latent image carrying member.

In a preferred embodiment, the image forming method of the present invention further comprises a recycling step. The recycling step is a step of returning the electrostatic image developing toner recovered in the cleaning step to the developer layer. The image forming method in this embodiment comprising a recycling step can be performed by using an image forming apparatus such as toner recycling system-type copying machine or facsimile machine. The image forming method of the present invention may also be applied to a recycling system where the cleaning step is omitted and the toner is recovered simultaneously with the development.

(Image Forming Apparatus)

The image forming apparatus of the present invention is an image forming apparatus using the electrostatic image developing toner of the present invention or the electrostatic image developer of the present invention.

The image forming apparatus of the present invention is preferably an apparatus where the above-described image forming method can be performed, and preferably an image forming apparatus comprising a latent image carrying member, electrically charging unit for electrically charging the surface of the latent image carrying member, developing unit for developing the electrostatic latent image by using a toner composition, and transfer unit for transferring the toner image to a recording material.

In the transfer unit, the transfer may be performed twice or more by using an intermediate transfer material.

Particularly, in the formation of a full color image by the image forming method of the present invention, from the standpoint of paper versatility and high image quality, color toner images of respective colors may be once transferred onto the surface of an intermediate transfer belt or intermediate transfer drum as the intermediate transfer material, and the color toner images stacked may be all together transferred onto the surface of a recording medium such as paper. Alternatively, color images of respective colors may be stacked and transferred directly on a recording material transported by a transportation belt.

The image forming apparatus may also be an image forming apparatus comprising a plurality of latent image carrying members, a plurality of electrically charging units for electrically charging the surface of the latent image carrying member, a plurality of latent image forming units for forming a latent image on the surface of the latent image carrying member, a plurality of developing units for developing the electrostatic image by using a toner, and a plurality of transfer units for transferring the toner image onto an intermediate transfer material or a recording material, that is, a tandem-type image forming apparatus.

As for the electrostatic latent image carrying member and those respective units, the constitution described above for each step of the image forming method may be preferably employed.

The above-described units each may be known unit used in the image forming apparatus. Also, the image forming apparatus of the present invention may comprise means, device and the like in addition to the constitution described above. Furthermore, the image forming apparatus of the present invention may cause a plurality of units described above to work at the same time.

(Printed Matter)

The printed matter of the present invention is a printed matter having an image formed by using the electrostatic image developing toner containing an amide ester represented by formula (1) of the present invention, and this is preferably a printed matter having an image formed by the image forming method of the present invention or the image forming apparatus of the present invention. Incidentally, the "image" as used here means not only an image such as picture but also an image in a broad sense, such as character and text.

Also, the printed matter of the present invention is sufficient if an image formed by the toner of the present invention is present in a part of the printed matter.

The recording material onto which the toner image is transferred is not particularly limited as long as a toner image can be formed thereon, but preferred examples include plain paper and OHP sheet used for a copying machine, a printer and the like in an electrophotographic system. In order to more enhance the smoothness on the image surface after fixing, the surface of the recording material is also preferably as smooth as possible and, for example, coated paper sheet obtained by coating the plain paper surface with a resin or the like, or an art paper sheet for printing may be preferably used.

EXAMPLES

The toner of this Example is obtained as follows. The following resin particle liquid dispersion, colorant particle liquid dispersion and releasing agent particle liquid dispersion are prepared and mixed at a predetermined ratio, and the mixed dispersion is ionically neutralized by adding a metal salt polymer with stirring, whereby an aggregate particle is formed. Subsequently, the pH in the system is adjusted from weakly acidic to neutral by adding an inorganic oxide, and the resulting dispersion is heated to a temperature higher than the glass transition point of the resin particle to coalesce and combine the aggregate particles. After the completion of reaction, a desired toner is obtained through the steps of thorough washing, solid-liquid separation and drying. Each preparation method is described below.

<Measurement of Crystal Melting Point and Glass Transition Point>

The measurement is performed according to the differential scanning calorimetry (DSC) by using DSC-20 (manufactured by Seiko Instruments & Electronics Ltd.), where about 10 mg of a sample is heated at a constant temperature rising rate (10° C./min) and the melting point is determined from the base line and the heat absorption peak.

<Measurement of Weight Average Molecular Weight Mw and Number Average Molecular Weight Mn>

As for the values of the weight average molecular weight Mw and the number average molecular weight Mn, the weight average molecular weight Mw and the number average molecular weight Mn are measured by gel permeation chromatography (GPC) under the conditions described below. The measurement is performed at a temperature of 40° C. by flowing a solvent (tetrahydrofuran) at a flow velocity of 1.2 ml/min, and injecting 3 mg as the sample weight of a tetrahydrofuran sample solution having a concentration of 0.2 g/20 ml. At the measurement of the molecular weight of a sample, the measurement conditions are selected such that the molecular weight of the sample is included in the range where a straight line is formed by the logarithm of molecular weight in the calibration curve created from several kinds of monodisperse polystyrene standard samples and the counted number.

In this connection, the reliability of the measurement results can be confirmed from the fact that when the molecular weight of an NBS706 polystyrene standard sample measured under the above-described conditions becomes:

weight average molecular weight $Mw=28.8\times10^4$ number average molecular weight $Mn=13.7\times10^4$ As for the column of GPC, TSK-GEL, GMH (produced by Tosoh Corp.) is used.

The solvent and the measurement temperature are changed to appropriate conditions according to the sample measured.

In the case where a resin particle liquid dispersion using an aliphatic polyester as the polyester and an aromatic-containing monomer as the addition-polymerizable resin is produced, at the analysis of the molecular weight of these two materials by GPC, each molecular weight may also be analyzed by post-mounting a device of separating UV and RI as a detector.

(Preparation of Resin Particle Liquid Dispersion (A))

| | |
|---|---|
| Dodecylbenzenesulfonic acid | 36 parts by weight |
| 1,9-Nonanediol | 80 parts by weight |
| 1,10-Decamethylenedicarboxylic acid | 115 parts by weight |
| Ion exchanged water | 1,000 parts by weight |

According to the formulation above, dodecylbenzenesulfonic acid, 1,9-nonanediol and 1,10-decamethylenedicarboxylic acid are mixed and fused under heating at 120° C., and the resulting oil-based solution is charged into ion exchanged water heated at 95° C. and immediately emulsified by a homogenizer (Ultra-Turrax T50, manufactured by IKA Works, Inc.) for 5 minutes. After further emulsification in an ultrasonic bath for 5 minutes, the emulsified product is held in a flask with stirring for 15 hours while keeping at 70° C.

In this way, Crystalline Polyester Resin Particle Liquid Dispersion (A) having a particle center diameter (median diameter) of 400 nm, a melting point of 70° C., a weight average molecular weight of 5,500 and a solid content of 18% is obtained.

In the particles of Resin Particle Liquid Dispersion (A), the overall proportion of particles having a median diameter of 0.03 μm or less or 5.0 μm or more (hereinafter referred to as a "large/small particle overall proportion") is 1.2%.

(Preparation of Resin Particle Liquid Dispersion (B): non-crystalline vinyl-based resin latex)

| | |
|---|---|
| Styrene | 460 parts by weight |
| n-Butyl acrylate | 140 parts by weight |
| Acrylic acid | 12 parts by weight |
| Dodecanethiol | 9 parts by weight |

The components according to the formulation above are mixed and dissolved to prepare a solution. After 12 parts by weight of an anionic surfactant (Dowfax, produced by Rhodia, Inc.) is dissolved in 250 parts by weight of ion exchanged water, the solution prepared above is added thereto and dispersed and emulsified in a flask (Monomer Emulsion A). Furthermore, 1 part by weight of the same anionic surfactant (Dowfax, produced by Rhoda, Inc.) is dissolved in 555 parts by weight of ion exchanged water and the resulting solution is charged into a polymerization flask. The polymerization flask is tightly plugged and after a reflux tube is equipped, the polymerization flask is heated to 75° C. on a water bath while injecting nitrogen and slowly stirring, and kept in this state.

Subsequently, 9 parts by weight of ammonium persulfate is dissolved in 43 parts by weight of ion exchanged water, the resulting solution is added dropwise into the polymerization flask through a metering pump over 20 minutes, and then Monomer Emulsion A is added dropwise through a metering pump over 200 minutes.

Thereafter, the polymerization flask is kept at 75° C. for 3 hours while continuing slowly stirring to complete the polymerization.

In this way, Anionic Resin Particle Liquid Dispersion (B) having a particle center diameter (median diameter) of 210 nm, a glass transition point of 53.5° C., a weight average molecular weight of 31,000 and a solid content of 42% is obtained.

In the particles of Resin Particle Liquid Dispersion (B), the large/small particle overall proportion is 0.2%.

| (Preparation of Colorant Particle Liquid Dispersion (Y)) | |
|---|---|
| Yellow pigment (C.I. Pigment Yellow 74, produced by Dainichiseika Colour & Chemicals Mfg. Co., Ltd.) | 50 parts by weight |
| Anionic surfactant (Neogen RK, produced by Dai-ichi Kogyo Seiyaku Co., Ltd.) | 5 parts by weight |
| Ion exchanged water | 200 parts by weight |

The components according to the formulation above are mixed and dissolved, and the resulting solution is dispersed by a homogenizer (Ultra-Turrax, manufactured by IKA Works, Inc.) for 5 minutes and further by an ultrasonic bath for 10 minutes to obtain Yellow Colorant Particle Liquid Dispersion (1) having a center diameter (median diameter) of 240 nm and a solid content of 21.5%.

(Preparation of Colorant Particle Liquid Dispersion (C))

Cyan Colorant Particle Liquid Dispersion (C) having a center diameter (median diameter) of 190 nm and a solid content of 21.5% is prepared in the same manner as Colorant Particle Liquid Dispersion (Y) except that in the preparation of Colorant Particle Liquid Dispersion (1), a cyan pigment (copper phthalocyanine C.I. Pigment Blue 15:3, produced by Dainichiseika Colour & Chemicals Mfg. Co., Ltd.) is used in place of the yellow pigment.

(Preparation of Colorant Particle Liquid Dispersion (M))

Colorant Particle Liquid Dispersion (M) having a center diameter (median diameter) of 165 nm and a solid content of 21.5% is prepared in the same manner as Colorant Particle Liquid Dispersion (Y) except that in the preparation of Colorant Particle Liquid Dispersion (1), a magenta pigment (C.I. Pigment Red 122, produced by Dai-Nippon Ink & Chemicals, Inc.) is used in place of the yellow pigment.

(Preparation of Colorant Particle Liquid Dispersion (BK))

Colorant Particle Liquid Dispersion (BK) having a center diameter (median diameter) of 170 nm and a solid content of 21.5% is prepared in the same manner as Colorant Particle Liquid Dispersion (Y) except that in the preparation of Colorant Particle Liquid Dispersion (1), a black pigment (carbon black, produced by Cabot, Inc., Reagal 330) is used in place of the yellow pigment.

| (Preparation of Releasing Agent Particle Liquid Dispersion) | |
|---|---|
| Paraffin wax (HNP9, produced by Nippon Seiro Co., Ltd.; melting point: 70° C.) | 50 parts by weight |
| Anionic surfactant (Dowfax, produced by The Dow Chemical, Co.) | 5 parts by weight |
| Ion exchanged water | 200 parts by weight |

The components according to the formulation above are heated at 95° C., and the resulting solution is thoroughly dispersed by a homogenizer (Ultra-Turrax T50, manufactured by IKA Works, Inc.) and then subjected to a dispersion treatment in a pressure jet-type homogenizer (Gaulin Homogenizer, manufactured by Gaulin Corp.) to obtain a releasing agent particle liquid dispersion having a center diameter (median diameter) of 180 nm and a solid content of 21.5%.

(Synthesis of Pearl Luster-Imparting Agent (N-stearoyl-N-methylaminoethyl stearate))

50 Parts by weight of 28% sodium methylate is added to 100 parts by weight of methyl stearate and 26 parts by weight of N-methylethanolamine, and an amidation reaction is allowed to proceed at 90° C. while removing methanol. Subsequently, sodium methylate is decomposed by using 66 parts by weight of 35% hydrochloric acid and after dehydration, sodium chloride is removed by filtration. Thereafter, 33 parts by weight of stearic acid is added to 100 parts by weight of the solid material, and an esterification reaction is performed at 170° C. while effecting dehydration, whereby N-stearoyl-N-methylamino-ethyl stearate is obtained.

Full Color Toner Example 1

| (Preparation of Toner Particle) | |
|---|---|
| N-Stearoyl-N-methylaminoethyl stearate | 10 parts by weight |
| Resin Particle Liquid Dispersion (A) | 233 parts by weight (resin: 42 parts by weight) |
| Resin Particle Liquid Dispersion (B) | 50 parts by weight (resin: 21 parts by weight) |
| Colorant Particle Liquid Dispersion (Y) | 40 parts by weight (pigment: 8.6 parts by weight) |
| Releasing Agent Particle Liquid Dispersion | 40 parts by weight (releasing agent: 8.6 parts by weight) |
| Polyaluminum chloride | 0.15 parts by weight |
| Ion exchanged water | 300 parts by weight |

The components according to the formulation above are thoroughly mixed and dispersed in a round stainless steel-made flask by a homogenizer (Ultra-Turrax T50, manufactured by IKA Works, Inc.), the flask is heated to 42° C. over a heating oil bath while stirring and then kept at 42° C. for 60 minutes, and after adding 50 parts by weight (resin: 21 parts by weight) of Resin Particle Liquid Dispersion (B), the solution is gently stirred.

Thereafter, the pH in the system is adjusted to 6.0 with 0.5 mol/liter of an aqueous sodium hydroxide solution, and then the solution is heated to 95° C. while continuing stirring. During the temperature elevation to 95° C., the pH in the system usually decreases to 5.0 or less but here, the pH is kept not to decrease to 5.5 or less by additionally adding dropwise the aqueous sodium hydroxide solution.

After the completion of reaction, the reaction solution is cooled, filtrated, thoroughly washed with ion exchanged water and then subjected to solid-liquid separation by Nutsche suction filtration. The solid portion is again dispersed in 3 liter of ion exchanged water at 40° C. and then washed by stirring at 300 rpm for 15 minutes. This washing operation is repeated five times. Subsequently, the resulting solution is subjected to solid-liquid separation by Nutsche suction filtration, and the solid portion is vacuum-dried for 12 hours to obtain toner particles.

The particle diameter of the obtained toner particle is measured by a Coulter counter, as a result, the accumulated volume average particle diameter $D_{50}$ is 4.6 μm, and the volume average particle size distribution index GSDv is 1.20. Also, the shape factor SF1 of the toner particle is determined by the observation of shape with a Luzex image analyzer and found to be 130 indicating that the particle has a potato-like shape.

Subsequently, 1.2 parts by weight of hydrophobic silica (TS720, produced by Cabot, Inc.) is added to 50 parts by weight of the toner particles obtained above and mixed in a sample mill to obtain an external addition toner.

A ferrite carrier having an average particle diameter of 50 μm, which is coated with polymethyl methacrylate (produced by Soken Chemical & Engineering Co., Ltd.) to a coverage of 1%, is used as the carrier and after weighing the external addition toner to give a toner concentration of 5%, the carrier and the toner are stirred and mixed in a ball mill for 5 minutes to prepare a developer.

(Evaluation of Toner)

Using the developer prepared above, the fixing property of the toner is examined in a modified machine of DocuCentre Color 500 manufactured by Fuji Xerox Co., Ltd., by using J coated paper produced by Fuji Xerox Co., Ltd. as the transfer sheet and adjusting the process speed to 180 mm/sec. As a result, it is confirmed that the oil-less fixing property by a PFA tube fixing roll is good, the minimum fixing temperature (this temperature is judged by the contamination of image when the image is rubbed with cloth) is 120° C. or more, the image revealed satisfactory fixing property, and the transfer sheet is separated without any resistance. The image obtained at a fixing temperature of 140° C. is a high-quality image assured of good surface gloss of 65%, satisfied in both developability and transferability and free from image defects. Also, generation of hot offset is not observed even at a fixing temperature of 200° C.

Furthermore, before the preparation of the toner, the stability of Resin Particle Liquid Dispersion (1) used is examined by a method such that 100 g of the resin particle liquid dispersion is weighed in a 300-ml stainless steel beaker and subjected to shear homogenization in the beaker for 1 minute by Ultra-Turrax T50 manufactured by IKA Works, Inc., the resulting resin particle liquid dispersion is filtered through a 77-micron nylon mesh, and whether or not the aggregation is generated is examined. As a result, generation of an aggregate is not observed at all and the liquid dispersion is in a stable state.

Example 2

A toner and a developer are prepared and evaluated in the same manner as in Example 1 except that the amount of N-stearoyl-N-methylaminoethyl stearate is changed to 60 parts by weight and Colorant Particle Liquid Dispersion (Y) is changed to Colorant Particle Liquid Dispersion (C).

Example 3

A toner and a developer are prepared and evaluated in the same manner as in Example 1 except that the amount of N-stearoyl-N-methylaminoethyl stearate is changed to 40 parts by weight and Colorant Particle Liquid Dispersion (Y) is changed to Colorant Particle Liquid Dispersion (M).

Example 4

A toner and a developer are prepared and evaluated in the same manner as in Example 1 except that the amount of N-stearoyl-N-methylaminoethyl stearate is changed to 5 parts by weight and Colorant Particle Liquid Dispersion (Y) is changed to Colorant Particle Liquid Dispersion (BK).

Comparative Examples 1 to 3

Toners and developers are prepared and evaluated in the same manner as in Examples 1 to 4, respectively, except for not adding N-stearoyl-N-methylaminoethyl stearate.

Using the toners and developers obtained in Examples 1 to 4 and Comparative Examples 1 to 3, the following evaluations are performed. The evaluation results are shown in Table 1 below.

<Evaluation of Glossiness>

An image sample produced by using the developer obtained above is fixed at 140° C. in DocuCentre Color 500CP manufactured by Fuji Xerox Co., Ltd., and the glossiness is measured by using GM26D manufactured by Murakami Color Research Laboratory under the condition that the angle of incident light to the image sample is 60°.

<Presence or Absence of Pearl Luster>

The presence or absence of pearl luster is evaluated with an eye.

TABLE 1

| | Amide Ester Represented by Formula (1) (parts by weight) | Colorant Particle Liquid Dispersion | $D_{50}$ (μm) | Glossiness (%) | Presence or Absence of Pearl Luster |
|---|---|---|---|---|---|
| Example 1 | N-stearoyl-N-methylaminoethyl stearate (10) | Y | 4.6 | 55 | present |
| Example 2 | N-stearoyl-N-methylaminoethyl stearate (60) | C | 4.6 | 65 | present |
| Example 3 | N-stearoyl-N-methylaminoethyl stearate (40) | M | 4.6 | 60 | present |
| Example 4 | N-stearoyl-N-methylaminoethyl stearate (5) | BK | 4.6 | 50 | present |
| Comparative Example 1 | none | Y | 4.6 | 60 | none |
| Comparative Example 2 | none | C | 4.6 | 60 | none |
| Comparative Example 3 | none | M | 4.6 | 60 | none |

As seen from Table 1, the electrostatic image developing toner containing an amide ester represented by formula (1) of the present invention can give an image having high glossiness and having pearl luster. On the other hand, in Comparative Examples, pearl luster cannot be obtained.

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents

What is claimed is:

1. An electrostatic image developing toner comprising:

a binder resin;

an amide ester represented by formula (1):

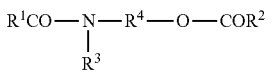

(1)

wherein $R^1CO$— and $R^2CO$— each independently represents a saturated or unsaturated acyl group having a carbon number of 16 to 24, which may have a hydroxyl, group, $R^3$ represents a linear or branched alkyl group having a carbon number of 1 to 3, $R^4$ represents a linear or branched alkylene group having a carbon number of 1 to 6 or a linear or branched alkenylene group having a carbon number of 2 to 6; and an amount of the amide ester represented by formula (1) is from 10 to 60 wt % based on a total weight of the toner.

2. The electrostatic image developing toner according to claim 1, wherein the binder resin is a polyester resin.

3. The electrostatic image developing toner according to claim 2, wherein the polyester resin has a weight average molecular weight of from about 1,500 to about 60,000.

4. The electrostatic image developing toner according to claim 1, wherein the binder resin is an addition polymerization-type resin.

5. The electrostatic image developing toner according to claim 4, wherein the addition polymerization-type resin has a glass transition temperature of from about 50 to about 70° C.

6. The electrostatic image developing toner according to claim 4, wherein the addition polymerization-type resin has a weight average molecular weight of from about 5,000 to about 50,000.

7. The electrostatic image developing toner according to claim 4, wherein the addition polymerization-type resin is a crosslinked resin formed by adding a crosslinking agent.

8. The electrostatic image developing toner according to claim 1, which further comprises a releasing agent.

9. The electrostatic image developing toner according to claim 8, wherein an added amount of the releasing agent is from about 1 to about 20 wt % based a total weight of the toner.

10. The electrostatic image developing toner according to claim 1, which has an accumulated volume average particle diameter $D_{50}$ of about 3.0 to about 9.0 μm.

11. The electrostatic image developing toner according to claim 1, which has a volume average particle size distribution index GSDv of about 1.30 or less.

12. The electrostatic image developing toner according to claim 1, which has a shape factor SF1 of from about 110 to about 140.

13. An electrostatic image developer comprising:

an electrostatic image developing toner according to claim 1; and a carrier.

14. The electrostatic image developer according to claim 13, wherein the carrier is coated with a resin.

15. An image forming method comprising:

foaming an electrostatic latent image on a surface of a latent image-holding member;

developing the electrostatic latent image formed on the surface of the latent image-holding member with a toner-containing developer to form a toner image;

transferring the toner image formed on the surface of the latent image-holding member to a surface of a transferee member; and heat-fixing the toner image transferred to the surface of the transferee member, wherein the toner is an electrostatic image developing toner according to claim 1.

16. An image forming apparatus comprising:

a latent image carrying member;

an electrical charging unit that electrically charges the surface of the latent image carrying member;

a developing unit comprising the electrostatic image developing toner according to claim 1; and a transfer unit that transfers a toner image to a recording material or an intermediate transfer material.

17. The image forming apparatus according to claim 16, comprising a plurality of transfer units that transfer the toner image onto an intermediate transfer material or a recording material.

18. A printed matter comprising an image, the image comprising the electrostatic image developing toner according to claim 1.

* * * * *